US005826923A

United States Patent [19]

Bethurem

[11] Patent Number: 5,826,923

[45] Date of Patent: Oct. 27, 1998

[54] SECURITY APPARATUS FOR HINGED DOOR

[76] Inventor: Gary J. Bethurem, 36332 Via Alamo, San Juan Capistrano, Calif. 92675

[21] Appl. No.: 749,821

[22] Filed: Nov. 14, 1996

[51] Int. Cl.[6] ..... E05C 19/18

[52] U.S. Cl. ..... 292/259 R; 292/238; 292/289

[58] Field of Search ..... 292/259 R, 289, 292/DIG. 46, 262, 276

[56] References Cited

U.S. PATENT DOCUMENTS

| | | | |
|---|---|---|---|
| 2,373,783 | 4/1945 | Schlifer | 292/259 |
| 3,806,179 | 4/1974 | Roessle | 292/259 |
| 3,986,741 | 10/1976 | Giovannini | 292/259 R |
| 4,318,559 | 3/1982 | Burton | 292/DIG. 46 |
| 5,022,245 | 6/1991 | Jordan et al. | 292/DIG. 46 |
| 5,340,172 | 8/1994 | Sweet | 292/259 |
| 5,466,023 | 11/1995 | Williamson | 292/259 R |
| 5,605,364 | 2/1997 | Shelledy | 292/259 R |

*Primary Examiner*—Brian K. Green
*Assistant Examiner*—Fredrick Conley
*Attorney, Agent, or Firm*—Morland C. Fischer

[57] ABSTRACT

A door security apparatus is provided which uniquely bars a door in a closed position when installed, but which leaves minimal hardware around the door when the door is not barred. The preferred apparatus includes a cross-member which carries two cylindrical end sleeves at opposite ends thereof. The cylindrical end sleeves releasably attach to extension members supported by mounting plates and extending beyond the plane of the door. The cylindrical end sleeves of the preferred embodiment slidably engage a hinge cylinder of an existing hinge on a hinged edge of the door and an extension member of a special side support on a latched edge of the door. If the existing hinge is opposed by other hardware, such as a door knob, then two special side supports may be used above or below the existing hinge. The preferred apparatus is formed from an extruded central section and two telescoping members which are telescopically joined to opposite ends of the central section. The cylindrical end sleeves may be chamfered along one edge thereof to accomodate spacing constraints encountered with typical decorative molding that surrounds the door.

10 Claims, 4 Drawing Sheets

SECURITY APPARATUS FOR HINGED DOOR

BACKGROUND OF THE INVENTION

1. Field of the Invention

The present invention generally relates to locking devices and more particularly to an external apparatus for securing a door in a closed position.

2. Description of Related Art

Security within a business or home has become an ever increasing concern. The consumer has come to demand ever better security devices for securing a door in a closed position.

One of the oldest known door security devices comprises a strong piece of timber and two L-shaped brackets for holding the timber across the face of a door. Such a structure has proven the test of time, but suffers from many disadvantages in a modern context. In particular, the timber is heavy, unsightly and difficult to store. Moreover, the L-brackets are used only to hold the timber and they must be permanently mounted to the wall on either side of the door in addition to the other hardware already used to hold the door. The L-shaped brackets are visually prominent and unsightly, and may even present a hazard to those passing through the doorway.

A more modern example of a door security device is sold under the trademark "DOORCLUB" (R). The DOORCLUB has been a marketing success, but it detrimentally secures the door at its bottom. Accordingly, if an intruder attempts to break down the door, it may pivot on the DOOR CLUB and break out of the door frame at an upper location.

There remains a need, therefore, for a door security device which affirmatively secures a closed door from one or more mid positions, but which has a non-intrusive aesthetically pleasing construction when not in use. Finally, there remains a need for a door security device which securely retains a closed door within the door frame, without slop, to prevent the door from breaching the security device by preventing it from gaining momentum before it reaches the security device.

SUMMARY OF THE INVENTION

The present invention provides a security apparatus that is adapted to a secure a door having a hinged edge that is pivotally mounted to a door frame and a latched edge that is moveable between an open and a closed position relative to the door frame.

In one aspect, the present invention comprises first and second side supports that are spaced from one another on opposite sides of the door, the first side support located on an inside surface of the door frame and adjacent to the hinged edge of the door, and the second side support located on an inside surface of the door frame and adjacent to the latched edge of the door. Each side support comprises a substantially flat mounting plate and an extension member carried by the mounting plate. Also provided are means for mounting the mounting plates of the first and second side supports to the inside surfaces of the door frame with their respective extension members protruding beyond the plane of the door when the door is closed; a cross-member; and means for releasably securing the cross-member between the respective extension members of the first and second side supports in order to secure the door whenever desired.

In a further aspect, the present invention provides the door security apparatus as described above, but wherein the first side support comprises an existing hinge having a hinge plate which serves as a mounting plate and a hinge cylinder which serves as the extension member, and wherein the second side support is a special side support that is secured to the inside surface of the door frame immediately opposite to the existing hinge so that the cross-member may be releasably secured between the existing hinge and the special side support.

In an even further aspect, the present invention provides a cross-member for use in securing a door wherein the cross-member comprises a central section and first and second cylindrical end sleeves carried by the central section. The cylindrical end sleeves have a vertical slot which extends upward from a bottom edge thereof and more dimensioned to slide respectively over the hinge cylinder of an existing hinge or the extension cylinder of a special side support. The vertical slots respectively accommodating the hinge plate of the existing hinge or the mounting plate of the special side support.

In an even further aspect, the present invention comprises two special side supports for use when an existing hinge is directly opposite a door knob, or some other obstruction, and cannot be used as described above. The two special side supports in this aspect of the invention are simply mounted above or below the existing hinge and door knob to support the cross-member without using any existing hardware.

BRIEF DESCRIPTION OF THE DRAWINGS

The objects and features of the present invention, which are believed to be novel, are set forth with particularity in the appended claims. The present invention both as to its organization and manner of operation, together with further objects and advantages, may best be understood with reference to following description, taken in connection with the accompanying drawings.

DESCRIPTION OF THE PREFERRED EMBODIMENT

Figure 1:
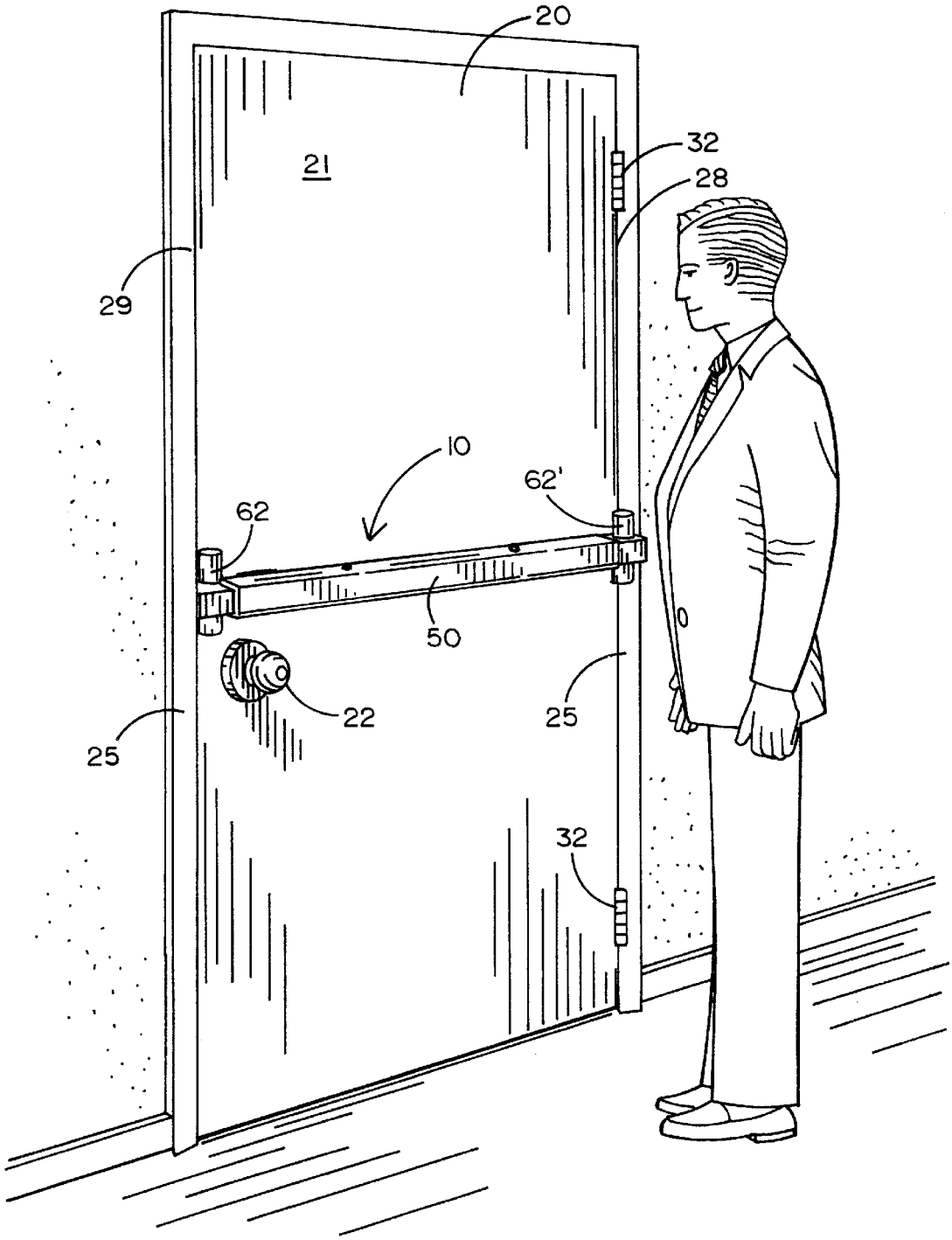
FIG. 1 is a perspective view of a preferred door security apparatus according to the present invention as installed on a door.

FIG. 1 shows a preferred door security apparatus 10 according to the present invention in its proper context, i.e. mounted adjacent to a door 20 to prevent the door 20 from being opened. As shown in FIG. 1, the door security apparatus 10 comprises a cross-member or central section 50 and a pair of cylindrical end sleeves 62, 62' which collectively span the door 20 between a hinged edge 28 of the door 20 and a latched edge 29 of the door 20. The door security apparatus 10 is hung between the respective door edges 28, 29 by releasably securing the cross-member 50 and cylindrical end sleeves 62, 62' between a pair of mounting plates (not shown in FIG. 1) as more fully described below. It can now be appreciated that the door security apparatus 10 prevents the door 20 from being opened when it is mounted as shown in FIG. 1.

The present invention advantageously provides an extremely high level of security when it is installed across the door, yet when it is removed from the door as explained below, very little of the device remains behind. As a result, the aesthetics of the doorway are not damaged and there are no intrusive L-shaped brackets, or the like, to create an eyesore or obstruction.

Figure 5:
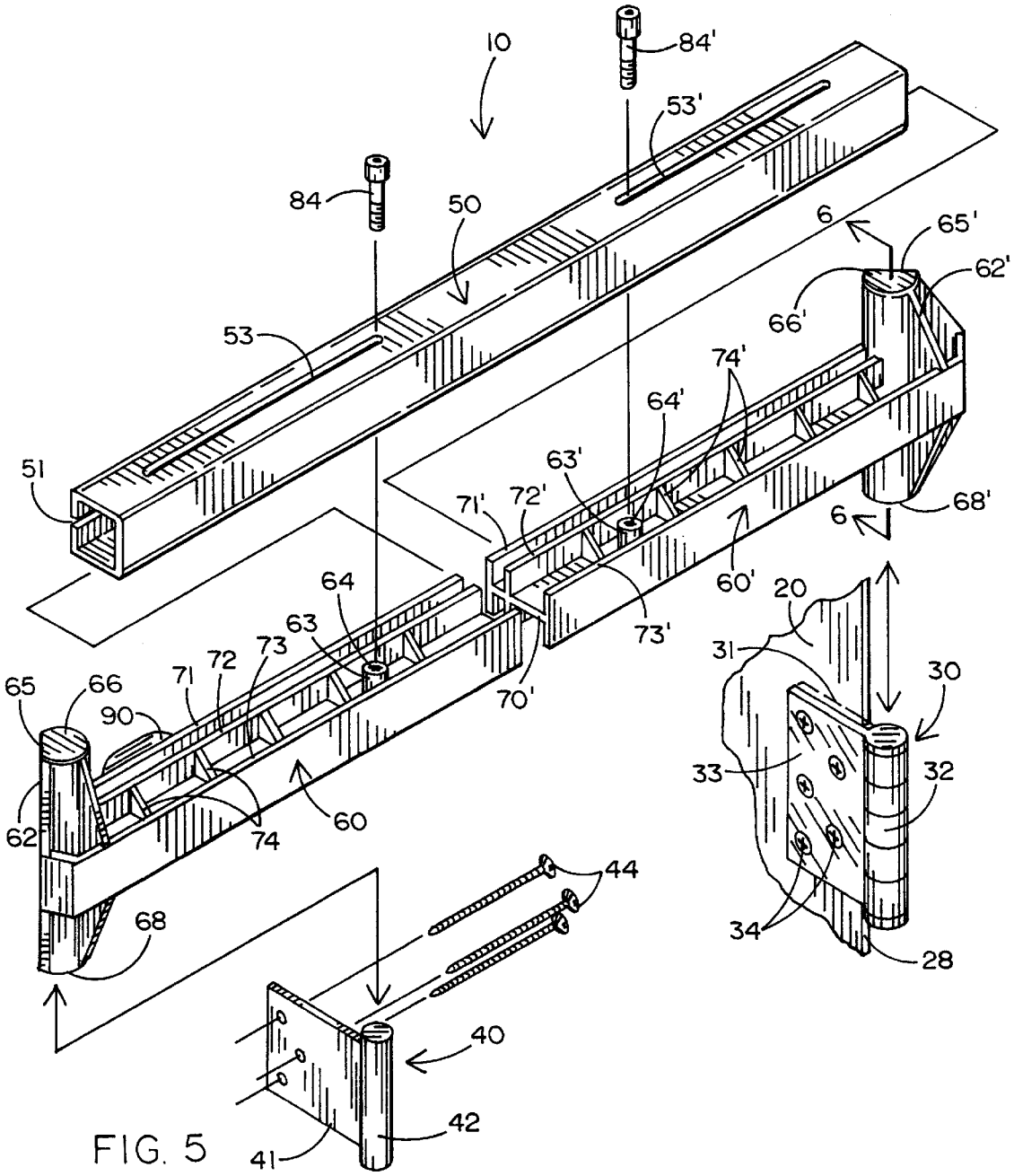
FIG. 5 is an exploded perspective view of the preferred door security apparatus including an extruded central section and a pair of injection molded, cylindrical end sleeves which telescopically connect to the extruded central section.
Figure 8:
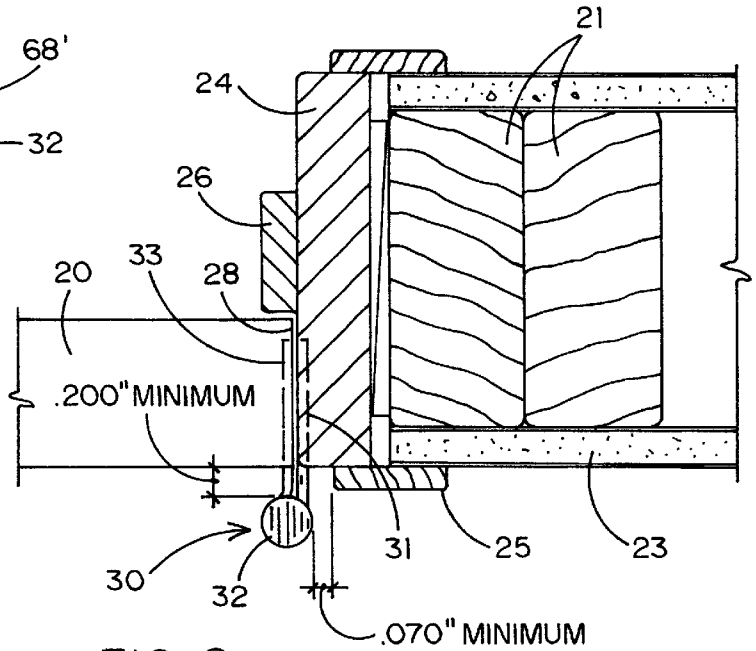
FIG. 8 is a cross-sectional view that shows typical spacing dimensions for an existing hinge cylinder.
Figure 7:
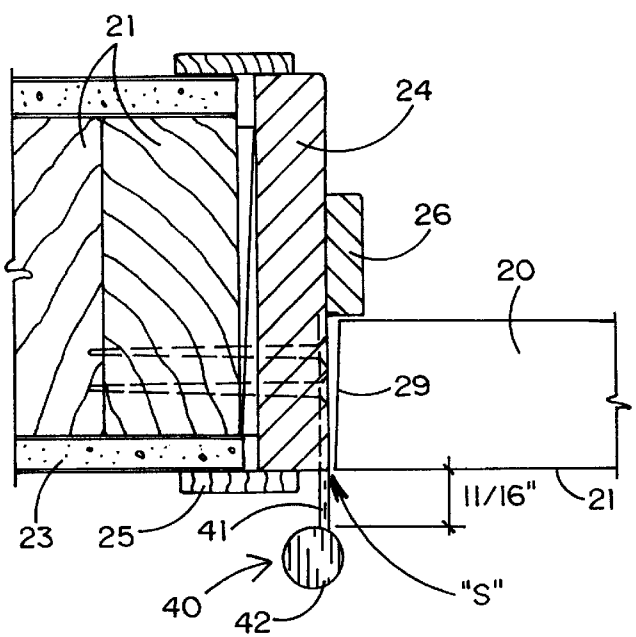
FIG. 7 is cross-sectional view that shows the preferred spacing dimensions of a special side support which permits the door to be swung freely through its arc.

The preferred door security apparatus 10 further includes first and second side supports 30, 40 that are spaced from one another on opposite sides of the door 20 as best shown FIGS. 5, 7 and 8. The first side support 30 is located on an inside surface of the door jam 24 and adjacent to the hinged edge 28 of the door and the second side support 40 is located on an inside surface of the door jam 24 and adjacent to the latched edge 29 of the door 20. As shown in the foregoing Figures, each side support 30, 40 preferably comprises a substantially flat mount plate 31, 41 and an extension member 32, 42, carried by the mounting plate. The first side support 30 preferably comprises an existing hinge 30, having a hinge plate 31 which serves as the mounting plate 31 and a hinge cylinder 32 which serves as the extension member 32. The second side support 40 preferably comprises a special side support 40 that is secured on the inside surface of the door jam 20, directly across from the existing hinge 30. This is the preferred embodiment because it only requires the installation of one special side support 40. If the existing hinge 30 is not available because it is opposite to the door knob 22, however, then the security apparatus 10 could be supported between two special side supports 40, 40 that are hung in opposition to one another, either above or below the existing door knob 22, and existing hinge 30.

Figure 6:
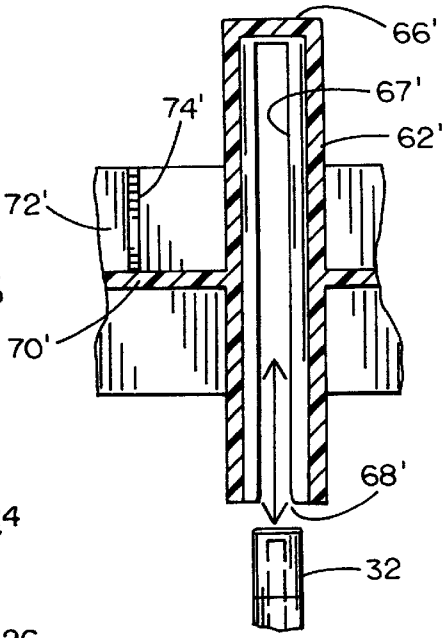
FIG. 6 is a cross-sectional view of the cylindrical end sleeve of FIG. 5 taken along section lines 6—6.

The door security apparatus 10 easily secures the door 20 by releasably joining the respective extension members 32, 42 of the first and second side supports 30, 40. The preferred releasable securing means comprises the first and second cylindrical end sleeves 62, 62' that are carried on opposite ends of the central section 50 and are dimensioned to slide over the extension members 32, 42 of the first and second side supports 30, 40. The preferred cylindrical end sleeve 62, 62' is sized to fit the cylindrical extension 42 or over the existing hinged cylinder 32. The preferred cylindrical end sleeve 62, 62' has a vertical slot 67, 67' which extends upward from the bottom edge to accommodate the mounting plate 41 of the special side support 40 and the hinge plate 31 of the existing hinge 30 as best shown in FIG. 6.

Figure 2:
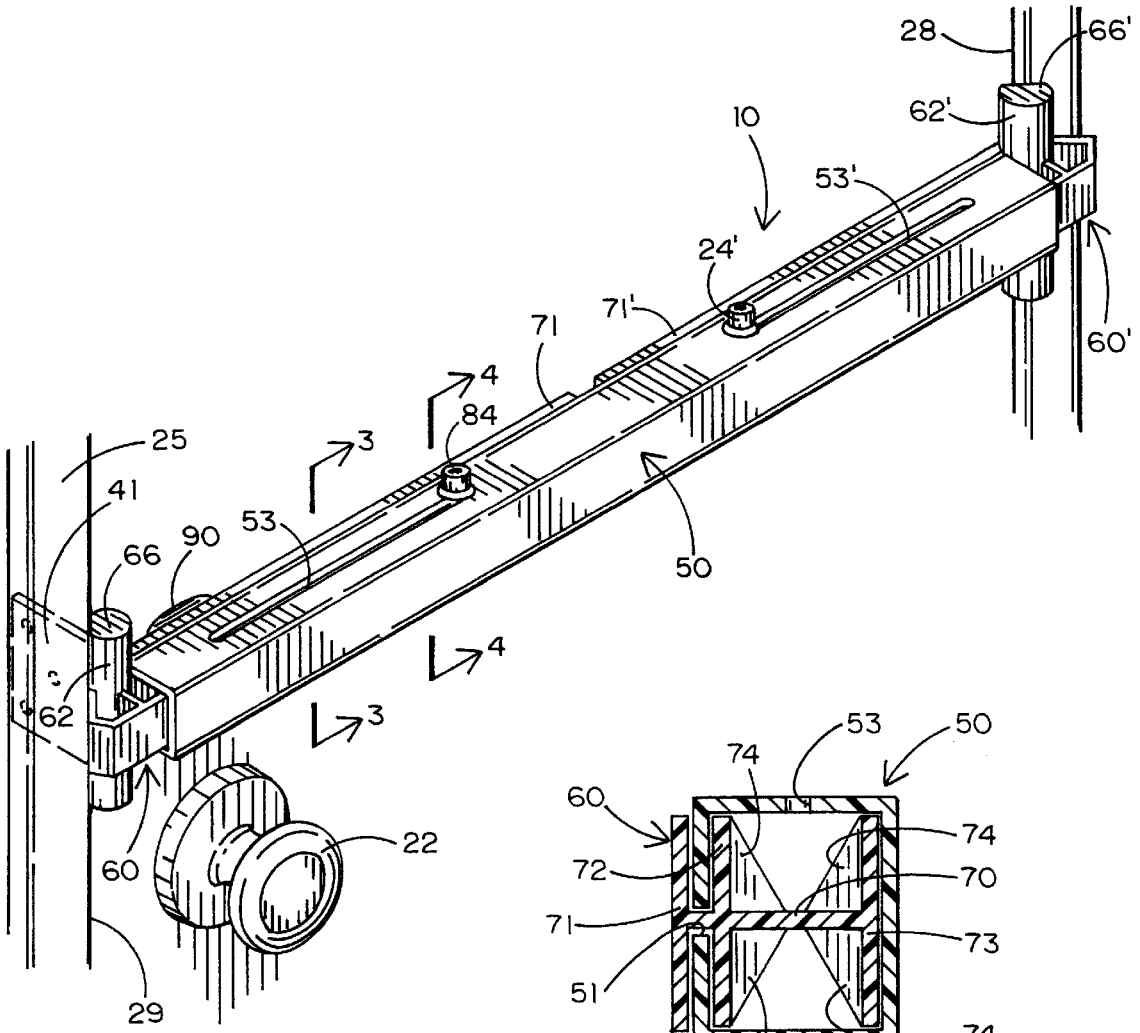
FIG. 2 is a closeup perspective view of the door security apparatus of FIG. 1.

As best shown in FIG. 2, the preferred door security apparatus 10 comprises an extruded central section 50 which carries an elongated slot 51 along its entire back side and a pair of adjustment slots 53, 53 on its top side. As shown, the security apparatus 10 further comprises first and second telescoping members 60, 60' which are telescopically joined to opposite ends of the extruded central section 50 and which respectively carry the first and second cylindrical end sleeves 62, 62'. The first and second telescopic member 60, 60' are a mirror image of one another. Accordingly, like parts are similarly identified with numbers except that one is identified with ordinary numbers and the other with prime numbers.

As best shown in FIG. 5, the telescoping member 60 generally comprises an elongated main body 70 which carries three vertical ribs 71, 72, 73 to form a hybrid I-Beam profile with two of the vertical ribs 71, 72 at a back side thereof and the other vertical rib 73 at a front side thereof. This unique profile permits the second and third vertical ribs 72, 73 to fit slidably inside of the extruded central section 50 with the first vertical rib 71 slidably located outside of the extruded central section 50 as best shown in FIGS. 3 and 4.

Figure 3:
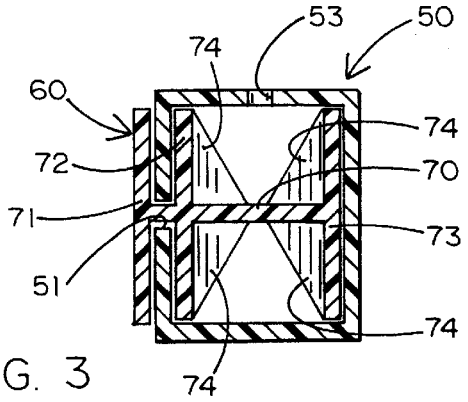
FIG. 3 is a cross-sectional view of the door security apparatus of FIG. 2 taken along section lines 3—3.
Figure 4:
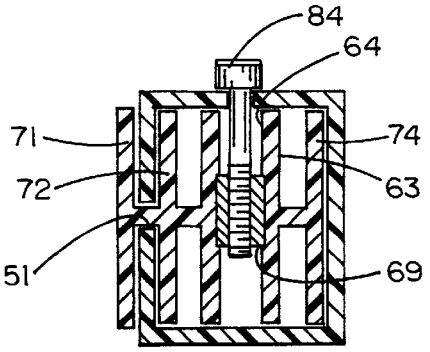
FIG. 4 is a cross-sectional view of the door security apparatus of FIG. 2 taken along section line 4—4.

As further shown FIGS. 3 and 5, the hybrid I-Beam construction of the telescoping member 60 further comprises a plurality of triangular supports 74 which help maintain the strength and rigidity of the vertical ribs 72, 73 while minimizing the amount of material needed to form the telescoping member 60.

As shown in FIG. 2, the first vertical rib 71 carries a spacer 90 on the outside of the extruded central section 50 the spacer 90 contacting the door 20 near its latched edge 29. The preferred spacer 90 is a round polymer disk with an appendage (not shown) that connects to an aperture (not shown) in the first vertical rib 71. As shown in FIG. 7, a gap must be present between the front plane 21 of the door 20 and the extension member 42 of the special side support 40 to permit the door 20 to swing freely through its arc "S". The preferred gap between the extension member 42 and the front plane 21 of the door 20 is 11/16". The spacer 90 is intended to fill the gap. Accordingly, the thickness of the spacer 90 is close to 11/16" the preferred thickness being 9/16". The unique spacer 90 fills the gap between the door 20 and the security apparatus 10 to prevent the door 20 from gaining momentum when an intruder tries to break down the door.

Returning to FIG. 5, it can be seen that the cylindrical end sleeve 62 carried by the telescoping member 60 is carefully integrated with the hybrid I-Beam construction of the main body 70. As shown, the first, second and third vertical ribs 71, 72 and 73 connect directly to the cylindrical end sleeve 62.

As can be understood by reviewing FIGS. 2, 5, 7 and 8, the cylindrical end sleeve 62 preferably has a chamfered edge 65 to accommodate the decorative molding 25 that often surrounds the door 20. The present inventor determined that it was necessary to include the chamfered edge 65, because the decorative molding 25 may be installed very close to the inside edge of the door frame 24. The wall thickness along the chamfered edge 65 can become quite thin. An upper cap 66 on the cylindrical end sleeve 62, however, strengthens the overall end sleeve 62 so that the reduction in wall thickness is not a concern.

The first and second telescoping members 60, 60' may beneficially slide in and out of the extruded central section 50 so that the security apparatus may span virtually any door 20. In a preferred embodiment, the first and second telescoping members 60, 60' are secured at desired positions within the central section 50 to define a particular width. As best shown in FIG. 4, the preferred securing means are two cap screws 84, 84' and two corresponding nuts 69, 69' which are over-molded, inside of the first and second telescoping members 60, 60'. The cap screw 84 passes through the slot 53 in the central section 50 and into an aperture 64 within a boss 63 carried by the telescoping member 60, to thereafter meet the screw 69. The cap screw 84 is tightened down, as clearly shown in FIG. 4, to secure the telescoping member 60 at any desired position relative to the central section 50 within the confines of the slot 53.

The special side support 40 is mounted to an inside surface of the door frame 24. The preferred means for mounting the special side plate 40 is a plurality of wood screws 44 which pass through apertures in the special side support 40, through the door frame 24, and into the studs 21 which define the door space. Other securing means such as adhesives and nails are of course possible, but wood screws are most practical.

By the use a special nylon material made by Dupont and known as ZYTEL 801 STF, it is possible to create a special side support 40 with a very thin mounting plate 41, as thin as a 100 thousandths of an inch (0.100"). Accordingly, if there is sufficient space between the door frame 24 and the latched edge 29 of the door 20, it may be possible to surface mount the side support 40 to the door frame 24. If such space does not exist, then the mounting plate 41 is recessed or flush mounted in the surface of the door frame 24 as is conventional with hinge plate 31 at the opposite side of the door.

More than one door security apparatus 10 may be used on a given door 20. If only one door security apparatus 10 is used, it should be mounted near the center of the door where an intruder is likely to apply force. If multiple security devices 10 are used, they should be located at equally spaced positions on the door 20. Two such devices 10, for example, should divide the door into equal thirds.

Those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

I claim:

1. A security apparatus for a door that is surrounded by and pivotally connected to a door frame, said security apparatus preventing the door from rotating relative to the door frame from a closed position to an open position and comprising:

a hollow support member including a wall having opposite ends and a first longitudinal slot located between said opposite ends;

at least one telescoping member surrounded by and moving reciprocally through said support member to adjust the length of said security apparatus, said telescoping member having a pair of parallel aligned ribs and a space running between said ribs to form a guide channel, a portion of said wall disposed within said guide channel so that said telescoping member is slidably coupled to said support member at said guide channel; and means adapted to connect said security apparatus to the door frame so that said support member and said telescoping member extend laterally across the door.

2. The security apparatus recited in claim 1, also comprising a second longitudinal slot located between the opposite ends of said hollow elongated support member, and a fastener extending through said second slot into engagement with said at least one telescoping member surrounded by said support member to prevent the movement of said telescoping member through said support member.

3. The security apparatus recited in claim 2, wherein said fastener is a screw, said at least one telescoping member having a receptacle by which to capture and releasably retain said screw when said screw is moved through said second slot and into engagement with said receptacle of said telescoping member.

4. The security apparatus recited in claim 1, comprising a pair of said telescoping members surrounded by and moving reciprocally through said hollow elongated support member at the respective opposite ends thereof, each of said pair of telescoping members having a pair of parallel aligned ribs and a space running between said ribs to form a guide channel, and each of said guide channels disposed within said first slot of said support member so that said pair of telescoping members are slidably coupled to said support member at said guide channels.

5. The security apparatus recited claim 4, also comprising a spacer located on one of said pair of ribs of each of said pair of telescoping members, said spacers adapted to engage the door to space said support member therefrom so as to restrict the rotation of the door towards said support member from the closed position to the open position.

6. The security apparatus recited in claim 4, wherein said means adapted to connect said security apparatus to the door frame includes first and second coupling members carried by respective ones of said pair of telescoping members and third and fourth coupling members to be attached to the door frame, said first and second coupling members being mated to said third and fourth coupling members.

7. The security apparatus recited in claim 6, wherein said first and second coupling members are hollow cylindral sleeves.

8. The security apparatus recited in claim 7, wherein said third and forth coupling members are mounting plates carrying respective cylindrical mounting pins, said hollow cylindrical sleeves receiving therewithin and surrounding said cylindrical mounting pins to couple said hollow cylindrical sleeves to said mounting pins, and said mounting plates adapted to be affixed to the door frame.

9. The security apparatus recited in claim 8, wherein each of said hollow cylindrical sleeves has an opening running longitudinally therethrough to accommodate respective ones of said mounting plates when said cylindrical sleeves receive and surround said cylindrical mounting pins.

10. A security apparatus for a door that is surrounded by and pivotally connected to a door frame, said security apparatus preventing the door from rotating relative to the door fame from a closed position to an open position and comprising:

a hollow elongated support member including a wall having opposite ends and a longitudinal slot located between said opposite ends;

first and second telescoping members surrounded by and moving reciprocally through the respective opposite ends of said support member to adjust the length of said security apparatus, each of said first and second telescoping members having a pair of parallel aligned ribs and a space running between said ribs to form a guide channel, a portion of said wall disposed within said guide channel so that said telescoping members are slidably coupled to said support member at said guide channels of said telescoping members; and means adapted to connect said security apparatus to the door frame so that said support members and said first and second telescoping members extend laterally across the door.

* * * * *